United States Patent [19]

Musick

[11] Patent Number: 4,603,533

[45] Date of Patent: Aug. 5, 1986

[54] APPARATUS FOR MANUFACTURING DISCRETE LAYERED UNITS FROM A WEB

[76] Inventor: Carroll Musick, 97 Union St., Erwin, Tenn. 37650

[21] Appl. No.: 513,175

[22] Filed: Jul. 13, 1983

Related U.S. Application Data

[63] Continuation-in-part of Ser. No. 248,486, Mar. 27, 1981, Pat. No. 4,479,295.

[51] Int. Cl.[4] ..... B65B 13/18

[52] U.S. Cl. ..... 53/117; 53/520; 53/582; 493/357; 493/414

[58] Field of Search ..... 493/411, 410, 413–415, 493/356, 357; 53/117, 430, 116, 520, 582, 589, 590

[56] References Cited

U.S. PATENT DOCUMENTS

| | | | |
|---|---|---|---|
| 946,393 | 1/1910 | Nichols . | |
| 2,420,525 | 5/1947 | Deloye . | |
| 2,449,663 | 9/1948 | Marcalus . | |
| 2,631,845 | 3/1953 | Zuckerman | 493/356 X |
| 3,711,085 | 1/1973 | Bunch, Jr. | 493/413 X |
| 3,717,335 | 2/1973 | Faltin . | |
| 3,868,809 | 3/1975 | Bledsoe . | |
| 4,045,012 | 8/1977 | Jakob | 493/415 |
| 4,054,283 | 10/1977 | Rayfield . | |
| 4,218,962 | 8/1980 | Cunningham et al. | 53/117 X |

*Primary Examiner*—James F. Coan
*Attorney, Agent, or Firm*—Luedeka & Neely

[57] ABSTRACT

The specification discloses a method and apparatus for producing folded ceramic fiber modules from an elongated web that are used as insulation units. The apparatus includes a feed mechanism and a surface defining mechanism operating cooperatively with a chute to produce a folded web which is then cut longitudinally to create two streams of separate folded units. A module may be produced by securing together a plurality of the folded units with bands, for example.

24 Claims, 11 Drawing Figures

APPARATUS FOR MANUFACTURING DISCRETE LAYERED UNITS FROM A WEB

The present invention is a continuation-in-part of U.S. application Ser. No. 06/248,486, filed Mar. 27, 1981, now U.S. Pat. No. 4,479,295, for A METHOD AND APPARATUS FOR MANUFACTURING DISCRETE LAYERED ARTICLES FROM A CONTINUOUS WEB.

The present invention relates to a method and apparatus for folding and cutting a web and particularly relates to a method and apparatus for folding and cutting ceramic batting to produce an insulation module. The manufacturing of modules of ceramic batting for use in commercial furnaces and ovens has, until recently, been performed by hand, and handmade modules are expensive to produce and are usually not uniform in size. The present invention provides a method and apparatus for inexpensively producing uniform modules at a high production rate relative to hand production.

Ceramic batting modules are required in various sizes for different applications. Generally, to produce a module with a machine, a web of batting needs to be folded to produce a folded serpentine stream of the batting with a desired width and then the module is cut from the serpentine stream. Equipment for manufacturing modules should have the capability of producing modules of different sizes as well as producing accurately sized modules. Generally, there are problems associated with feeding and folding flexible materials through a pair of feed rolls to initiate folding. Flexible materials, such as ceramic batting, have a tendency during folding to follow or stick to the roll instead of being properly folded. Moreover, the serpentine stream of folded material must be continuously urged away from the feed rolls which can interfere with the folding process or disturb the folds produced.

In Application Ser. No. 06/248,486 a mechanism having a reciprocating chute to produce folds in a web is disclosed. The present invention reciprocates the web as it is fed into a chute and, thus, does not require reciprocation of the chute.

To produce accurate folds in a mechanized process, it is necessary to coordinate the feed rate with the size of the fold produced and the reciprocation or fold rate. Thus, a control mechanism is needed to coordinate feed rate and the reciprocating motion of the webb which not only produces accurate modules but also makes equipment easily adaptable to the manufacturing of different sized modules.

Cutting modules to the desired size from the folded material is a difficult task because the cut must be made at the same position on a fold in all of the modules. In addition, waste should be eliminated when one supply roll of material is exhausted and a new roll is introduced. Thus, there is a need for a method and an apparatus which eliminates the step of cutting the modules individually from the folded material. Moreover, there is a need for a mechanism which minimizes waste at the end of a roll of supply material.

The method of the invention generally includes the feeding of an elongated web of batting toward a chute while laterally oscillating the batting. The folded batting is cut vertically to divide the material into two streams of individual folded units. The units are then collected in a selected number and are fastened together to produce a module. In one form of the invention, the folded batting is cut vertically down the center to form two streams of individual folded units with equal width and, thus, to produce modules of equal size from each stream.

Modules of different widths may be produced by the method by varying the size of the reciprocations to produce different sized folds. The rate of feeding must be correspondingly varied to adjust for larger folds.

In using the method, the folding process is best accomplished by employing two flexible sheets supported on shafts located adjacent the chute which define a fixed surface with respect to the folded batting and provide an aperture for the incoming batting. The sheets aid in the folding process by keeping the batting from sticking to the feed rolls and the sheets also push the folded batting through the chute.

In accordance with one aspect of this method, the web is fed in an initial feed path and is repetitively pushed or urged in a first direction for a selected distance. The first direction is substantially perpendicular to the initial feed path. After each time the web is urged in the first direction, it is urged in a second direction, opposite from the first direction, for the selected distance. Thus, a folded serpentine web is formed that is then cut into insulation modules.

In accordance with one form of the apparatus of the present invention, there is provided a mechanism for folding a web of material into a folded serpentine configuration having two rows of folded edges, a mechanism for cutting the web longitudinally and generally parallel to the folded edges of the folded web to produce a series of folded units, and a mechanism for separating a selected number of the folded units for being secured together to produce a module.

In accordance with a more particular aspect of the present invention there is provided an apparatus for folding a web of material into a serpentine configuration within a chute that includes a feed mechanism for feeding the web in an initial feed path toward the chute at a selected feed rate. The feed mechanism is reciprocated at a selected reciprocation rate in a transverse direction generally perpendicular to the initial feed path, and a surface defining structure is disposed between the feed mechanism and the chute. An aperture is defined in the surface defining structure for admitting the web therethrough and into the chute, and the aperture moves at the selected reciprocation rate in a reciprocal motion following the motion of the feed mechanism so that the feed mechanism and the aperture operate cooperatively to fold the web in the chute and to urge the folded web through the chute.

In accordance with another more particular aspect of the present invention, the aforementioned surface defining structure may include first and second parallel spaced-apart shafts mounted adjacent to the feed mechanism and between the feed mechanism and the chute. First and second sheets of material each having a fixed end and a free end are disposed about the shafts. The fixed ends of each of the sheets are attached at opposite stationary positions lateral from said first and second parallel shafts and generally between the feed mechanism and the chute. Each of the sheets extends from a stationary position toward the first and second shafts to form a face section. The face sections are disposed to engage the folded web and present stationary surfaces to the folded web in the chute. Each of the sheets have mid-sections. The midsection of the first sheet is disposed around and carried on the first shaft, while the mid-section of the second sheet is disposed around and carried on the second shaft. Each of the sheets have a tail section extending from the mid-section to the free end of such sheet. The apparatus includes a mechanism for yieldably holding the free end of each of said sheets to hold the first and second sheets tautly on the first and second shafts, respectively. An aperture is thus defined by the space between the first and second shafts. The mechanism for yieldably holding is operable to allow movement of the free end of one sheet toward the shafts and to allow movement of the free end of the other of the sheets away from the shafts as the shafts are reciprocated. While held tautly, the first and second sheets are operable to drive the folded web down the chute, and to cooperatively effect the folding of the web.

In accordance with another aspect of the present invention, there is provided an apparatus for folding the web of material into a serpentine configuration within a chute in which a feed mechanism feeds the web in an initial feed path toward the chute at a selected feed rate, and a monitor produces a feed rate signal corresponding to the feed rate. The feed mechanism is reciprocated at a selected reciprocation rate in a transverse direction generally perpendicular to the initial feed path and another monitor produces a reciprocation rate signal corresponding to the reciprocation rate. A controller is responsive to the feed rate signal and the reciprocation rate signal for controlling feed rate and the reciprocation rate so that the required quantity of web is fed into the chute for each reciprocation cycle.

The present invention may best be understood by reference to the following detailed description when considered in conjunction with the accompanying drawings in which.

Figure 1:
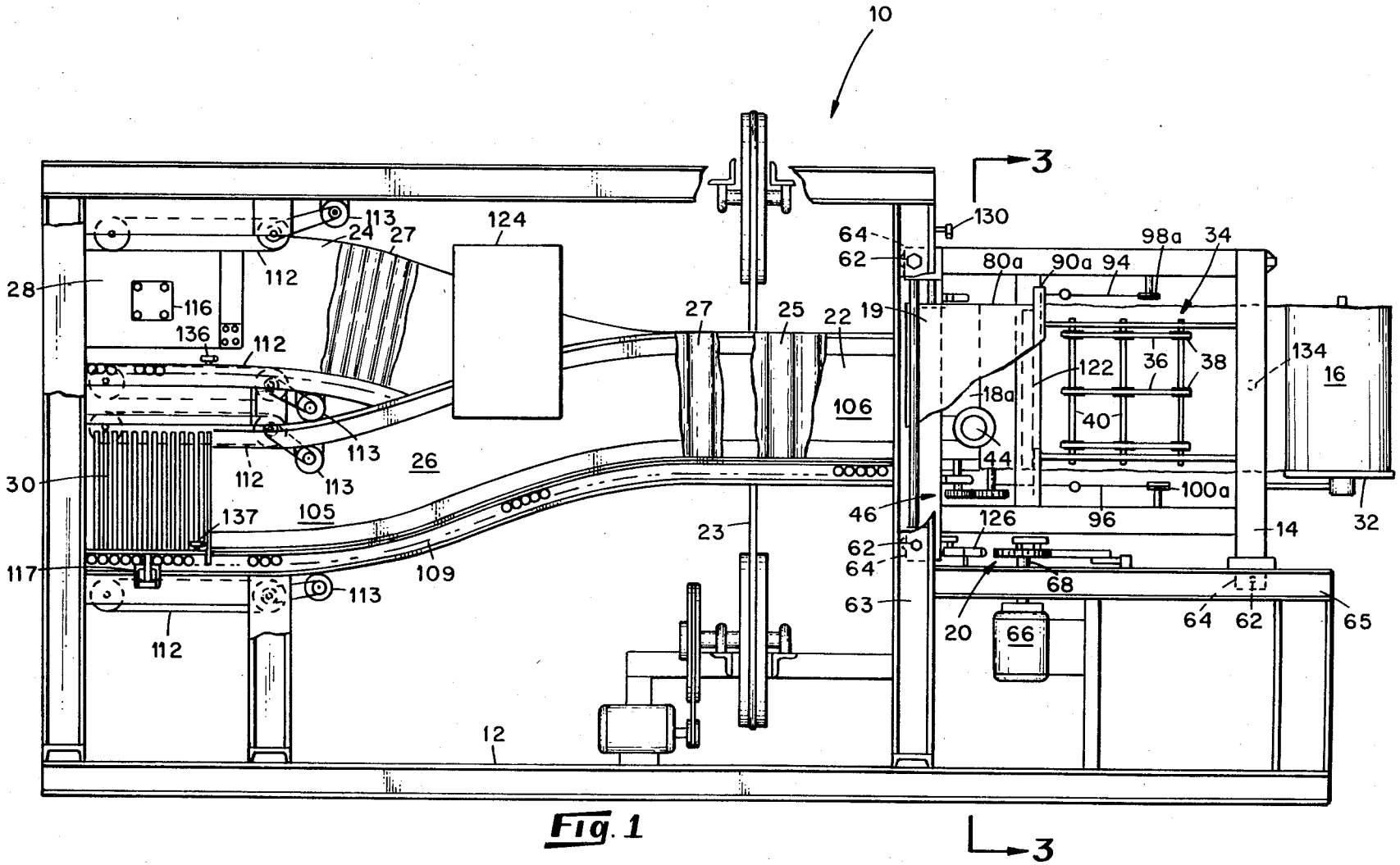
FIG. 1 is a partially cut-away side elevational view of an apparatus embodying the present invention.
Figure 2:
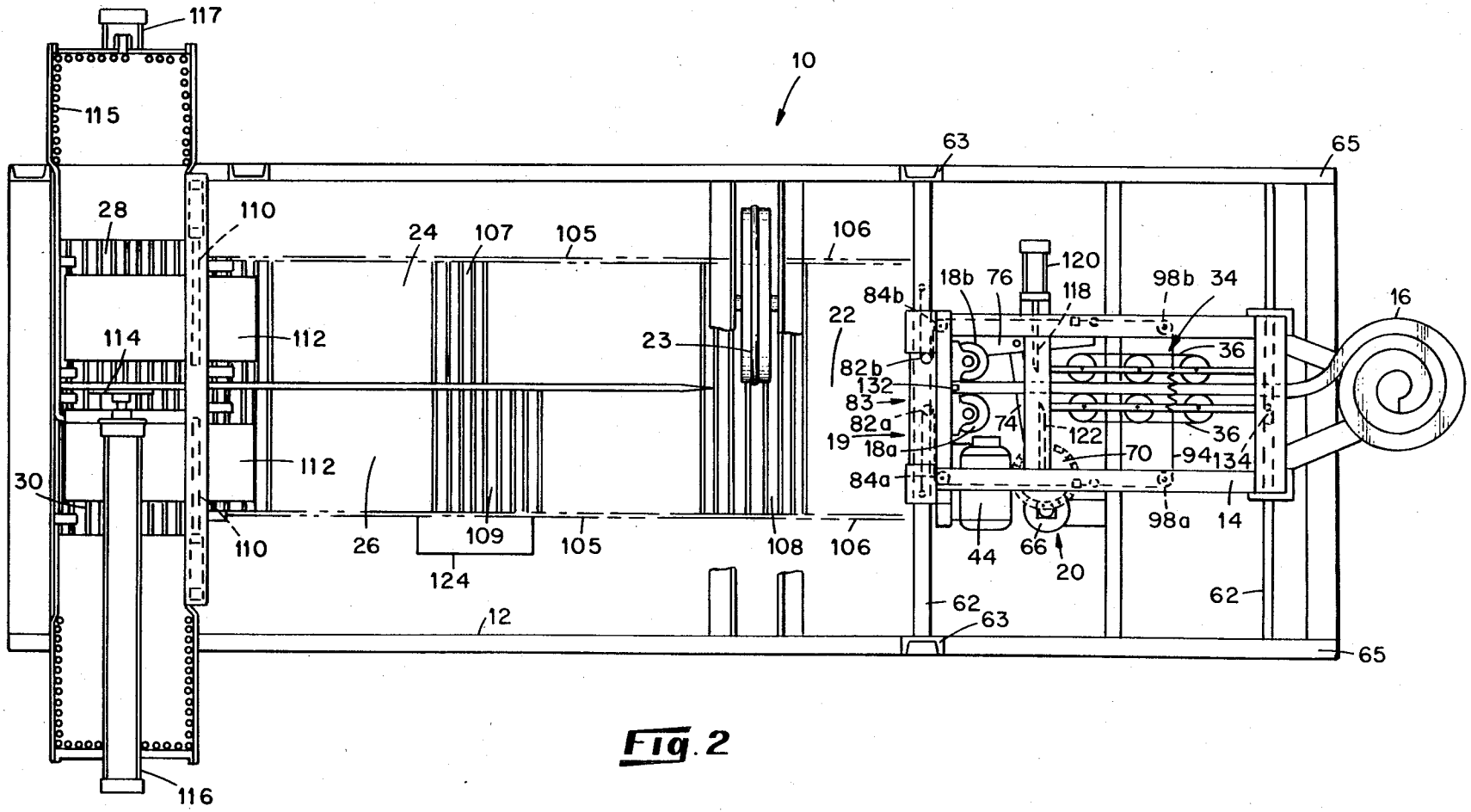
FIG. 2 is a top plan view of an apparatus embodying the present invention.
Figure 3:
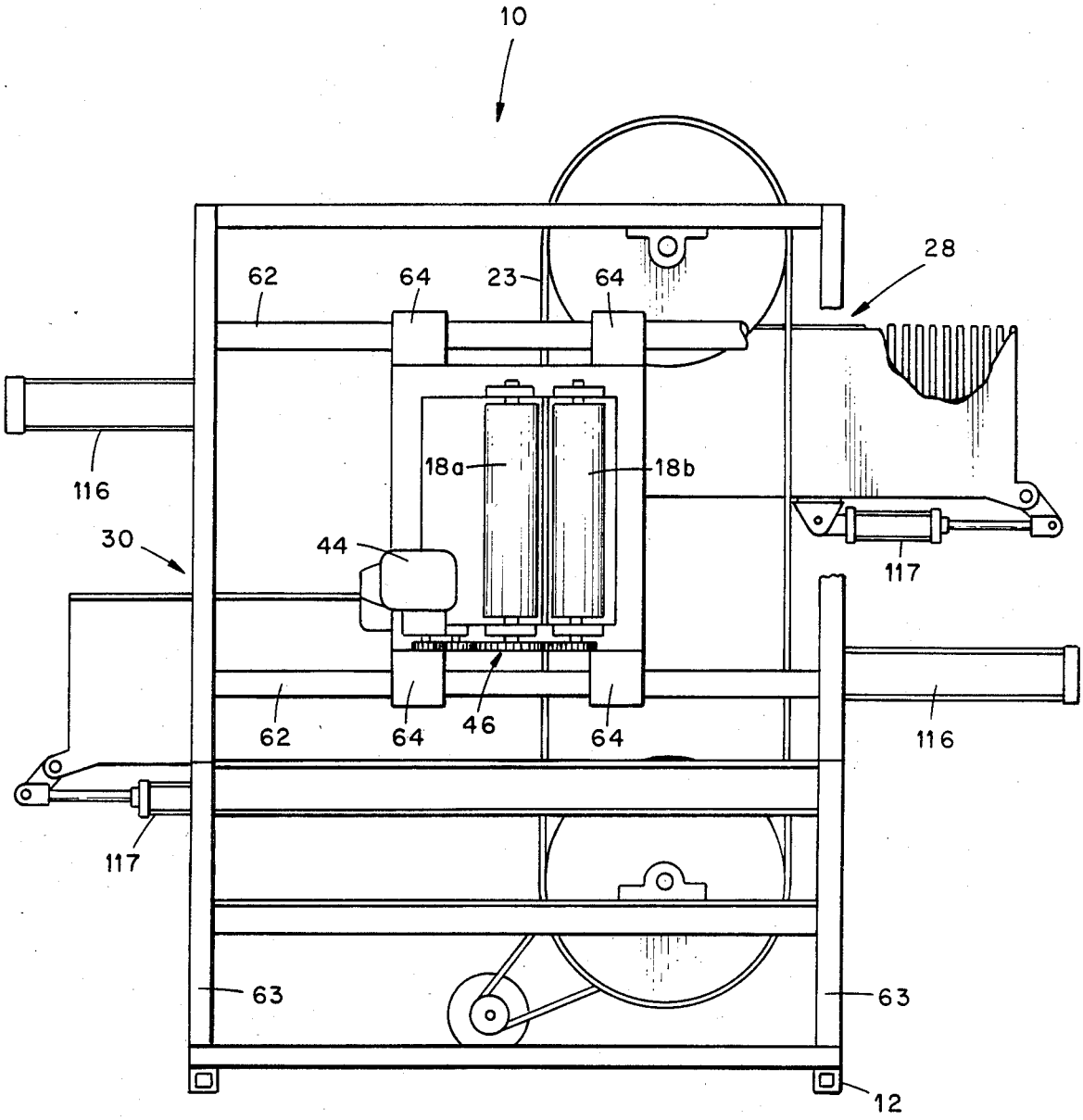
FIG. 3 is a slightly enlarged partially cut-away cross-sectional end view of the apparatus of FIG. 1 taken along line 3—3.
Figure 4:
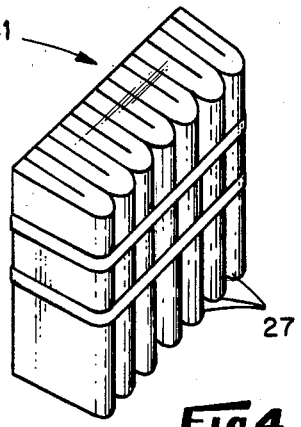
FIG. 4 is a perspective view of a module manufactured in an apparatus embodying the present invention.
Figure 5:
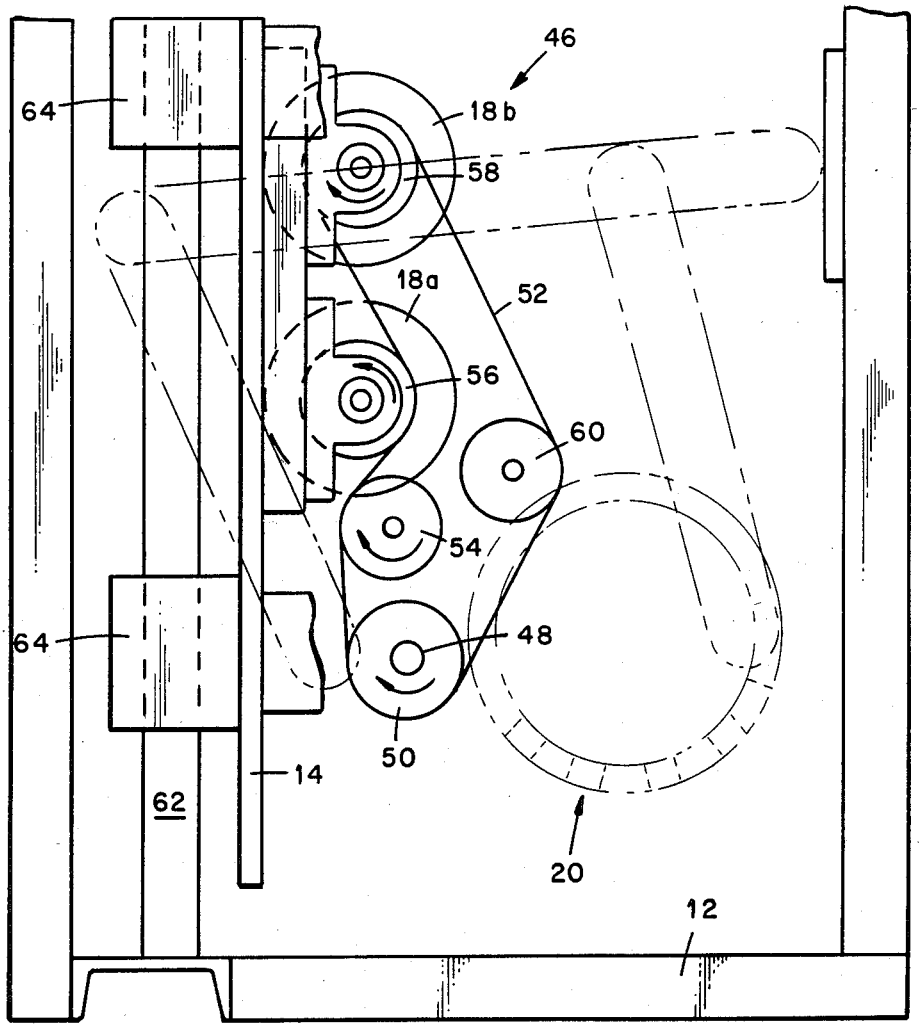
FIG. 5 is a partially cut-away enlarged top view of the feed roll drive mechanism of an apparatus embodying the present invention.

Referring now to the drawings in which like reference characters designate like or corresponding parts throughout the several views, there is shown in FIG. 1 an apparatus 10 embodying various features of the present invention. The apparatus 10 includes an elongate step-shaped main frame 12 having a series of suitable support legs, longitudinal members, and cross pieces. A traveling frame 14 is mounted for transverse motion on the lower end of the main frame 12. A roll of ceramic fiber batting 16 is mounted for free rotation on the traveling frame 14 and feeds into a pair of feed rolls **18*a* and 18*b* which are also mounted on the traveling frame 14. (Only 18*a* is shown in FIG. 1. Both 18*a* and 18*b* are shown in FIGS. 2 and 3.) The traveling frame 14 along with the feed rolls 18*a* and 18*b* and other structures mounted on the traveling frame 14 are reciprocated by the reciprocating mechanism 20 which is shown in FIG. 5 and discussed hereinafter. A layering chute 22 is mounted on the main frame 12 adjacent to the traveling frame 14. Between the feed rolls 18*a* and 18*b* and the layering chute 22, is a surface defining mechanism 19 which acts cooperatively with the feed rolls 18*a* and 18*b* and the layering chute 22 to produce folds in the fiber batting 16 as it is fed into the layering chute 22. A folded serpentine batting stream 25 is, thus, formed in the layering chute 22. At the end of the layering chute 22, a band saw 23 is vertically mounted in the center of the chute 22 to cut the batting stream 25 into separate folded units 27. At the position of the band saw 23, layering chute 22 is connected to an upper chute 24 and a lower chute 26. The upper chute 24 conveys the cut and folded units 27 to an upper counting and fastening station 28. The lower chute 26 conveys cut and fold units 27 to a lower counting and fastening station 30. A selected number of cut and folded units 27 are separated and ejected from the apparatus 10 at each station 28 and 30 and the units may be fastened together by suitable means as by a conventional banding machine (not shown) to produce a module 31 as shown in FIG. 4**.

Referring now more particularly to FIGS. 1 and 2, the apparatus 10 of the present invention includes a turntable and vertical spindle 32 attached to the traveling frame 14 on which the roll of ceramic batting 16 is mounted. The apparatus 10 has the capability for producing modules from ceramic batting ranging from three inches to twenty-four inches wide and ranging from one-half inch to two inches in thickness. Adjacent to the turntable and vertical spindle 32 is a start-up feed mechanism 34 which supplies batting 16 to the feed rolls 18 during start-up. The start-up feed mechanism 34 includes six start-up feed belts 36 (Three of which are shown in FIG. 1 and two of which are shown in FIG. 2) carried on pulleys 38 and shafts 40 mounted for rotation on the traveling frame 14. The start-up feed belts 36 are located in two spaced-apart vertical stacks of three belts defining a vertically oriented passageway leading from the feed roll 16 to the feed rolls **18*a* and 18*b*. The start-up feed belts 36 may be driven by a belt drive mechanism (not shown) which drives one of the shafts 40 for each stack of three belts 36 causing the three belts on one side to be moved in a rotational direction opposite to the belts 36 on the other side so that batting 16 may be pulled from the roll of batting 16 to the feed rolls 18*a* and 18*b*. The pulleys 38 and shafts 40 are mounted for lateral motion on the traveling frame 14 so that start-up feed belt mechanism may selectively be moved in and out of contact with the batting. A start-up feed mechanism air cylinder (not shown) may be actuated by the operator to move the two spaced-apart stacks of start-up feed belts 36 to a contact position or to a clearance position. The spacing of the contact position is just slightly less than the thickness of the ceramic batting 16 so that the belts 36 engage the surface of the batting 16 and compress it sufficiently to maintain friction between the belts 36 and the surface of the batting 16. FIG. 2 shows the start-up feed belts 36 in contact with the batting 16. The start-up feed mechanism 36** is actuated by the operator of the equipment only during start-up of the apparatus.

Referring now to both FIGS. 1, 2 and 3, the feed rolls 18*a* and 18*b* are shown mounted on shafts which are journaled on bearings mounted on the traveling frame 14 in a vertical orientation adjacent to the higher portion of the main frame 12. The feed rolls 18*a* and 18*b* are laterally spaced-apart by a distance of about one inch and are knurled to provide additional frictional engagement with the batting.

The feed rolls 18*a* and 18*b* are driven by an electric motor and gear box 44 mounted on the traveling frame 14. As shown generally in FIGS. 1 and 3, feed roll drive mechanism 46 is connected to the electric motor and gear box 44. Referring now to FIG. 5, an enlargement of the feed roll drive mechanism 46 is shown. The gear box shaft 48, which rotates in a clockwise direction when viewed from the top, carries a pulley 50 which drive a drive belt 52. The drive belt 52 forms a circuitous path from the pulley 50 to drive the feed rolls 18*a* and 18*b*. The drive belt 52 first extends from the pulley 50 to a first idler pulley 54 and then loops around the first feed roll pulley 56 mounted on feed roll 18*a*. The belt 52 extends around the side of the feed roll pulley 56 which faces a roll of ceramic batting 16 so that the feed roll 18*a* is rotated in a counterclockwise direction. The belt then loops around a second feed roll pulley 58 mounted on feed roll 18*b* in the opposite direction so that feed roll 18*b* is rotated in a clockwise direction. As the belt 52 continues, it rides on a second idler pulley 60 to complete the circuit. First and second feed roll pulleys 56 and 58 have identical radii, whereby the feed rolls 18*a* and 18*b* are driven at equivalent speeds of rotation although they rotate in opposite directions.

As mentioned previously, the traveling frame 14 is mounted for transverse motion. Referring to FIGS. 1 and 3, the mounting method is shown. Three horizontal bars 62 are mounted on the main frame 12, two of the horizontal bars 62 are mounted between upright members 63 on the end of the higher portion of the main frame 12 adjacent to the traveling frame 14, and the third horizontal bar 62 is mounted between the uppermost longitudinal members 65 of the lower portion of the main frame 12 near the end. Six slide bearings 64 are mounted on the traveling frame 14 in locations corresponding to the location of the three horizontal bars 62. Two slide bearings 64 are used for each horizontal bar 62. These bearings 64 are disposed about and slide upon the horizontal bar 62, thus allowing transverse motion of the traveling frame 14.

Figure 6:
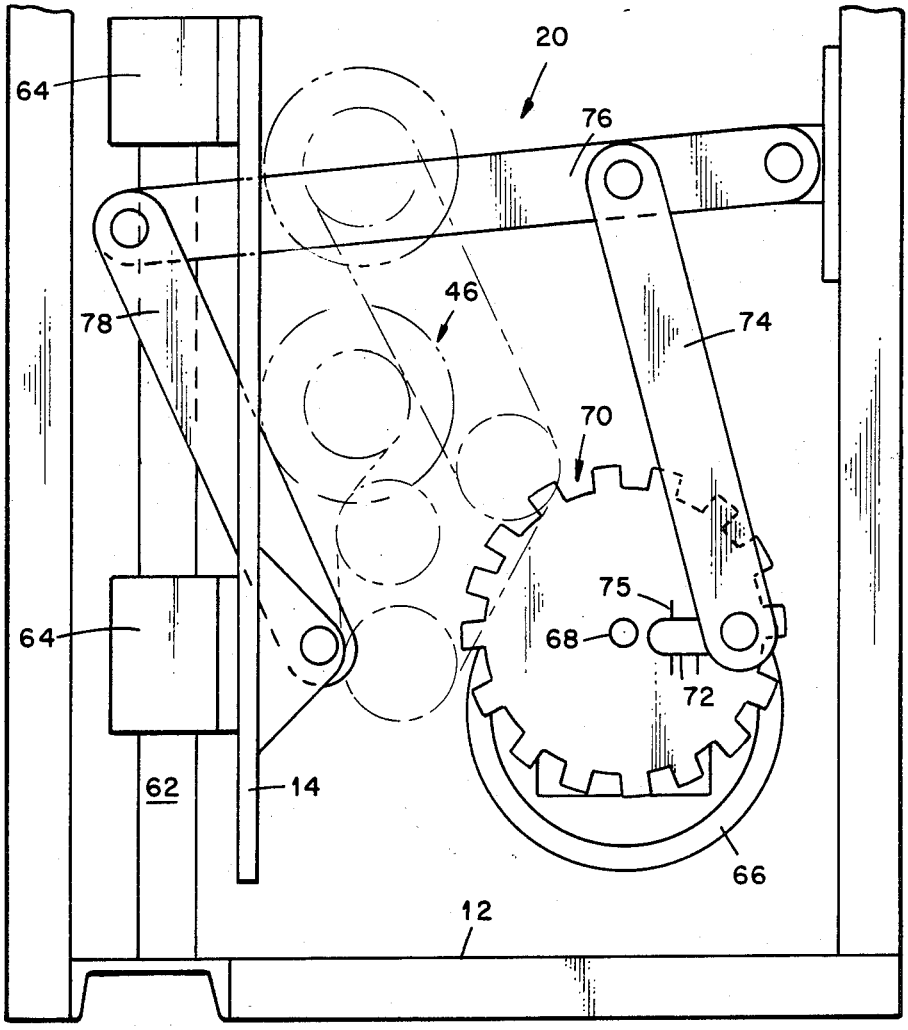
FIG. 6 is a partially cut-away enlarged top view of the reciprocating mechanism of an apparatus embodying the present invention.
Figure 7:
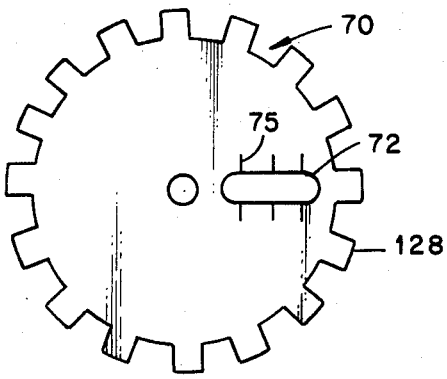
FIG. 7 is an enlarged top view of a crank wheel of the reciprocating mechanism.

The location of the reciprocating mechanism 20 for the traveling frame 14 is shown generally in FIG. 1. A reciprocating mechanism motor and gear box 66 is attached to the lower portion of the main frame 12 below the traveling frame 14. Referring now to FIG. 6, an enlarged top view of the reciprocating mechanism 20 is shown. The gear box shaft 68 is attached to the crank wheel 70. The crank wheel 70 is also shown separately in FIG. 7. A slot 72 is formed in the upper surface of crank wheel 70 along a radius of the crank wheel 70. Although the slot 72 is shown in FIGS. 6 and 7 extends only along a portion of a radius of the crank wheel 70, it will be understood that the slot 72 could extend entirely across the surface of the crank wheel 70 along a diameter thereof. As shown in FIG. 5, a connecting rod 74 is pivotally attached on one end in the slot 72 at any of several selected positions by a conventional clamping or friction fit mechanism. The several positions are marked by lines 75 on the crank wheel 72. The other end of the connecting rod 74 is pivotally connected to a first pivot rod 76 at a location intermediate its ends. The first pivot rod 76 is pivotally connected at one end to a cross piece on the main frame 12 and at the other end it is pivotally connected to a second pivot rod 78 which in turn is attached to the traveling frame 14. Rotational motion of the crank wheel 70 is thus used to reciprocate the traveling frame 14. By varying the position of attachment of the connecting rod 74 in the slot 72 on the crank wheel 70, the distance of reciprocation may be varied and varying fold widths may be produced.

Figure 8:
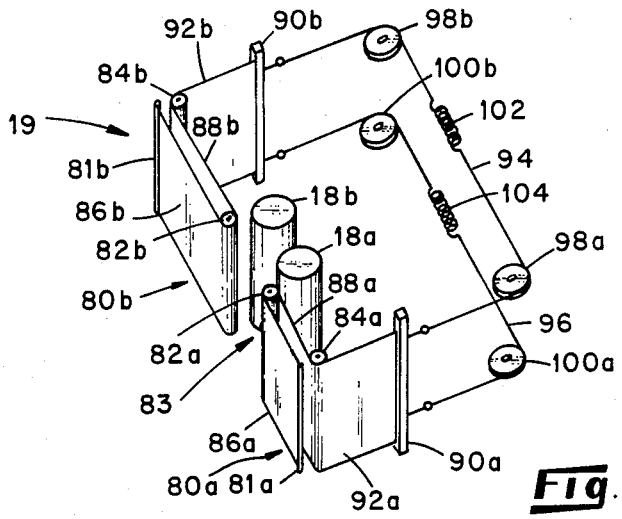
FIG. 8 is a somewhat diagrammatical isometric view of the drive rolls and the surface defining mechanism of an apparatus embodying the present invention shown removed from the apparatus.

The folding of the ceramic batting 16 occurs as the pair of feed rolls 18*a* and 18*b* feed the batting into the layering chute 22 while being reciprocated along with the traveling frame 14. As mentioned, a surface defining mechanism 19 acts cooperatively with the pair of feed rolls 18*a* and 18*b* and the layering chute 22 to produce the folds. FIG. 1 shows the surface defining mechanism 19 partially cutaway to show other elements of the apparatus 10, and FIG. 2 shows the general orientation of the surface defining mechanism 19 in relation to the layering chute 22 and the feed rolls 18*a* and 18*b*. (The surface defining mechanism 19 is not shown in FIG. 3). FIG. 8 is a perspective view of a surface defining mechanism 19 and the pair of feed rolls 18*a* and 18*b* shown removed from the apparatus. Referring now to FIGS. 1, 2 and 8, there is shown two vertically disposed flexible sheets 80*a* and 80*b* disposed between the layering chute 22 and the feed rolls 18*a* and 18*b* which extend longitudinally in a circuitous path. The vertical dimension of the flexible sheets 80*a* and 80*b* is approximately fourteen inches. A first pair of vertical shafts 82*a* and 82*b* are mounted for rotation between upper and lower cross pieces on the traveling frame 14 adjacent to the feed rolls 18*a* and 18*b* and are positioned between the layering chute 22 on the main frame 12 and the feed rolls 18*a* and 18*b* on the traveling frame 14. A second pair of vertical shafts 84*a* and 84*b* are mounted for rotation between upper and lower outermost longitudinal members of the traveling frame 14 adjacent to the end of the traveling frame 14. Thus, each of the shafts 82*a*, 82*b*, 84*a* and 84*b* are carried on and travel with the traveling frame 14.

Each of the flexible sheets 80*a* and 80*b* attach vertically at one end, which are referred to as fixed ends 81*a* and 81*b*, to an upright member of the main frame 12 at locations laterally spaced outwardly from the first pair of vertical shafts 82*a* and 82*b*. The flexible sheets 80*a* and 80*b* extend inwardly toward each other from the fixed ends 81*a* and 81*b*, respectively, to the first pair of vertical shafts 82*a* and 82*b* to define vertical face sections 86*a* and 86*b* which are disposed parallel to the direction of reciprocation of the traveling frame 14. The flexible sheets 80*a* and 80*b* are then wrapped one hundred eighty degrees (180°) around the first pair of vertical shafts 82*a* and 82*b*, respectively, in the direction of the feed rolls 18*a* and 18*b* and then extend laterally outwardly to the second pair of vertical shafts 84*a* and 84*b*, respectively, to define mid-sections 88*a* and 88*b* which are parallel to the face sections 86*a* and 86*b*. Flexible sheets 80*a* and 80*b* then wrap ninety degrees (90°) around the second pair of parallel shafts 84*a* and 84*b* in the direction of the roll of ceramic batting 16. The flexible sheets 80*a* and 80*b* extend from the second pair of parallel shafts 84*a* and 84*b* to vertical tie bars 90*a* and 90*b*, respectively, to define tail sections 92*a* and 92*b* which are perpendicular to the mid-sections 88*a* and 88*b*.

An upper cable 94 and a lower cable 96 connect the tie bars 90*a* and 90*b* together. Upper pulleys 98*a* and 98*b*, mounted on the traveling frame 14, carry cable 94 so that it extends first from the tie bar 90*a* in a direction perpendicular to the face sections 86*a* and 86*b*. Then the cable 94 is routed around the pulley 98*a* and extends in a direction parallel to the face sections 86*a* and 86*b* to the pulley 98*b* where the cable is again directed perpendicular to the face sections 86*a* and 86*b* to the tie bar 90*b* where it is attached. Lower cable 96 is attached in a similar fashion and is carried by lower pulleys 100*a* and 100*b* which are also mounted on the traveling frame 14. Upper spring 102 is incorporated into the upper cable 94 on the length of the cable between the two pulleys 98*a* and 98*b*. Lower spring 104 is incorporated into the lower cable 96 on the length of the cable between the two pulleys 100*a* and 100*b*. Springs 102 and 104 maintain tension in the cable which thus maintain the sheets 80*a* and 80*b* in a taut condition.

Figure 9:
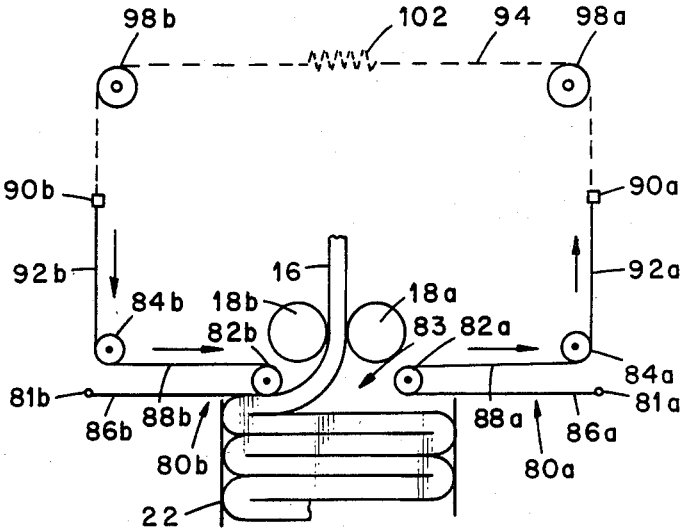
FIG. 9 is a diagrammatical top view of the feed roll, the surface defining mechanism, and the web of batting with the drive rolls centered with respect to the layering chute.
Figure 10:
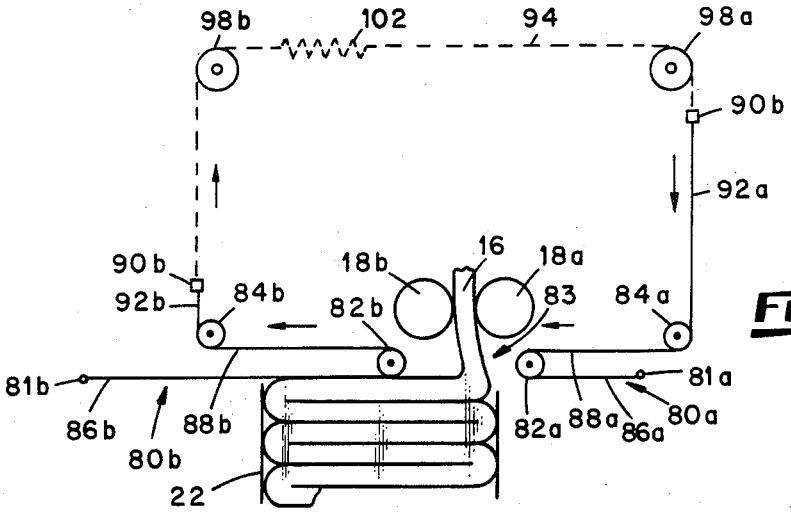
FIG. 10 is a diagrammatical top view of the feed rolls, surface defining mechanism, and the web of batting with the drive rolls off-center with respect to the layering chute.
Figure 11:
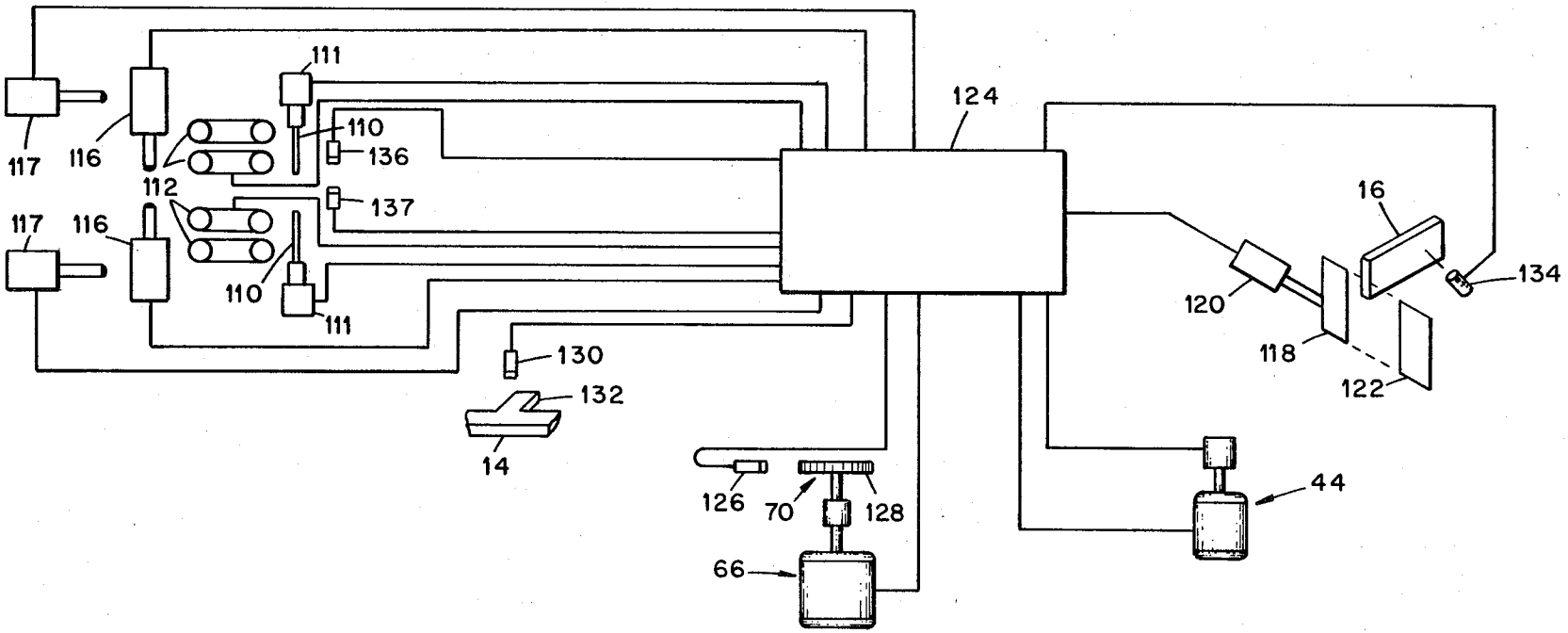
FIG. 11 is a diagrammatical view of a control system of an apparatus embodying the present invention.

Referring now to FIGS. 9 and 10, there is shown a diagrammatical top view of the feed rolls 18*a* and 18*b*, the surface defining mechanism, and the ceramic batting. In FIG. 9 the feed rolls 18*a* and 18*b* are shown centered with respect to the layering chute 22. The diagram shows the feed rolls 18*a* and 18*b* feeding the batting into the chute 22 with the traveling frame 14 carrying the feed rolls 18*a* and 18*b* and moving to the right to produce the fold. The two pairs of shafts 82*a* and 82*b*, and 84*a* and 84*b*, are moving to the right in this diagram as well. This causes the flexible sheets 80*a* and 80*b* to be moved through and around the shafts 82*a*, 82*b*, 84*a* and 84*b*. The tail section 92*b* is rolling around shaft 82*b* and is thus decreasing in length and the mid-section 88*b* is rolling around shaft 82*b*. Consequently, face section 86*b* is increasing in length and remains in fixed position relative to the chute 22 as additional flexible sheeting is added to its length adjacent to the shaft 82*b*. Correspondingly, tail section 92*a* is increasing in length as mid-section 88*a* is rolling around shaft 84*a*. Face section 86*a* is therefore decreasing in length while it remains in a stationary position relative to the chute 22.

FIG. 10 shows the configuration of feed rolls 18*a* and 18*b* in the surface defining mechanism 19 when the traveling frame 14 has moved to the right to an off-center position and is now moving back to the left. Tail section 84*b* has decreased in length and tail section 84*a* has increased in length. Face section 86*b* is longer than in the center position shown in FIG. 9 and face section 86*a* is shorter than in the centered position in FIG. 9.

The upper and lower cables 94 and 96 move through the pulleys 98*a* and 98*b* and 100*a* and 100*b*, respectively, as the flexible sheets 80*a* and 80*b* move through and around the shafts. For example, in FIG. 9, when the feed rolls 18*a* and 18*b* move to the right, the length of the cables 94 and 96 between the pulleys 98*a* and 98*b*, and 100*a* and 100*b*, will move to the left. The springs 102 and 104 provide generally uniform tension on the flexible sheets 80*a* and 80*b* during reciprocation of the traveling frame 14.

The movement of the flexible sheets 80*a* and 80*b* and the cables 94 and 96 is similar when the traveling frame is moving to the left as shown in FIG. 10.

FIGS. 9 and 10 show the face sections 86*a* and 86*b* in contact with the fold of batting 16. As the feed rolls 18*a* and 18*b* are reciprocated, the face sections 86*a* and 86*b* remain essentially fixed with respect to the folded batting 16 in chute 22. As the batting is fed into the layering sheet 22, the flexible sheet 80*b*, in contact with the batting, is rolling around shaft 82*b*. The flexible sheet 80*b* therefore draws the batting 16 from the feed roll 18*b* and pushes it into the layering chute 22. Because the flexible sheet rolls around the shaft 82*b* at the rate the feed roll is reciprocated, little or no sliding occurs between the flexible sheet 80*b* and the batting 16. Similarly, flexible sheet 80*a* contacts the folded batting 16 adjacent to it in the chute 22 and maintains the batting 16 in position until another layer of batting is deposited by the feed rolls 18*a* and 18*b*. The apparatus 10 functions in a similar manner when the traveling frame 14 is moving to the left. Flexible sheet 80*a* will roll around shaft 82*a* and will maintain contact with the incoming batting and will push the batting into the chute 22. Correspondingly, flexible sheet 80*b* will maintain the position of the folded batting in the chute 22.

In summary, it will be appreciated that the flexible sheets 80*a* and 80*b* provide a stationary surface formed by face sections 86*a* and 86*b* which engage and drive the batting 16 in the layering chute 22. In addition, a moving aperture 83, defined by the space between shafts 82*a* and 82*b*, is provided which reciprocates in unison with the reciprocation of the traveling frame 14.

In addition to driving the batting 16 down the chute 22, the flexible sheets 80*a* and 80*b* function to pull (or hold) the batting 16 clear of the rolls 18*a* and 18*b*, thus, eliminating the problem of the batting 16 sticking to the rolls 18*a* and 18*b*.

Referring again to FIGS. 1 and 2, the layering chute 22 is shown having vertical side walls 106 and a roller bed floor 108. Side walls 106 are laterally adjustable to accommodate different sized folds of the batting 16. The band saw 23 is positioned at the end of the layering chute 22 and, at the band saw 23, layering chute 22 divides into an upper chute 24 and a lower chute 26. The side walls 106 of the layering chute 22 are continuous with the outside walls 107 of the upper and lower chutes 24 and 26 and are adjustable for different sized folds of batting 16. Roller bed extends continuously from the floor 108 of the layering chute 22 to the floor 107 of the upper chute 24 and to the floor 109 of the lower chute 26.

As the folded batting moves down the layering chute 22, the band saw 23, located at the end of the layering chute 22, vertically cuts the folded batting 16 into two streams of folded units 27 of equal width. One of these two streams moves through the upper chute 24, and the other moves through the lower chute 26 to the counting and ejecting stations 28 and 30, respectively.

At each counting and ejecting station 28 and 30, the selected number of the cut and folded units (in this embodiment seven units) are separated from the stream of such units and are collectively ejected from the apparatus 10. The units are rotated 90° for the purpose of facilitating the banding or other fastening operation. During ejection, keeper plates 110 (shown in FIG. 2), which are actuated by keeper plate air cylinders 111, are located in the upper and lower chutes 24 and 26 adjacent to the counting and ejection stations 28 and 30. The keeper plates 110 are placed in the path of the advancing units during ejection. In order to advance the units into the chute 24 or 26 when a prior group of units have been ejected, the keeper plates 110 are removed from the chutes 24 and 26. Upper and lower belts 112 extend from the end of the upper and lower chutes 24 and 26 into each counting and ejection station 28 and 30. The belts 112, which contact the top and bottom of the folded units, advance the units into position for ejection and prevent the folded units from falling down when they are moved into the vacant ejection station. First pushers 114 eject the units from the ejection stations, and second pushers 115 rotate the units 90° to facilitate banding or other fastening method. FIG. 3 shows the location of the first pusher air cylinders 116 which actuate the first pushers 114, and second pusher air cylinders 117 which actuate the second pushers 115.

Referring, again, to the front end of apparatus 10 in the area of the traveling frame 14, there is provided a planar blade 118 with a vertical edge mounted for transverse motion on the traveling frame 14 between the start-up feed mechanism 34 and the feed rolls 18*a* and 18*b*. An air cylinder 120 may be actuated to urge the planar blade 118 laterally to pass by a second blade 122 very closely to cut the batting 16 which extends between the two blades 120 and 122.

The various functions of the apparatus 10 are monitored and controlled by a controller 124 which, in the preferred embodiment, is a Texas Instrument Computer, Model No. 510. Referring to FIG. 10, the controller 124 monitors the speed of the gear box of the electric motor and gear box 44 of the feed roll drive mechanism 46. Controller 124 is capable of adjusting the speed of the electric motor within a range of operating speeds.

The controller 124 also monitors the action of the crank wheel 70 of the reciprocating mechanism 20. A crank wheel electric eye 120 mounted upon the traveling frame 14 adjacent to the crank wheel 70 detects the teeth 128 on the crank wheel 70 as the crank wheel 70 rotates. The electric eye 126 produces a first detection signal each time a tooth 128 passes before it, and the controller 124 receives and counts the first detection signals and, thus, monitors the position of the crank wheel 70. The position of the traveling frame 40 is indicated by the position of the crank wheel 70 and, by monitoring the crank wheel 40, the controller 124 is monitoring the position of the traveling frame 14. When the controller 124 counts sixteen teeth 128 passing in front of the electric eye 126, the crank wheel 70 has made a complete revolution and the traveling frame 14 has completed a reciprocation cycle, and then the counting is repeated.

A reciprocation electric eye 130, mounted centrally on the traveling frame 14 adjacent to the higher portion of the main frame 12, is used to directly count the actual reciprocations of the traveling frame 14 as it passes a centered stub 132 on the main frame 12. The reciprocation electric eye 130 produces a second detection signal each time the centered stub 132 passes by the eye 130, and the controller 124 counts the second detection signals to monitor the reciprocation of the traveling frame 14.

By counting the passing teeth 128 on the crank wheel 70, the reciprocation rate of the traveling frame is, thus, monitored. By counting the passing of the centered stub 132 by the eye 130, the reciprocation rate of the traveling frame is double checked.

The controller 124 controls the speed of the reciprocating mechanism electric motor and gear box 66 and the speed of the motor and gear box 44 (which drives the feed rolls 18*a* and 18*b*). According to parameters, namely the length of batting 16 in one fold, programmed into the controller 124, the feed rate of the feed rolls 18*a* and 18*b* are coordinated with reciprocation rate of the traveling frame to produce folds of the selected size. When different sized folds of batting 16 are desired, the position of the connecting rod 74 in the slot 72 is varied as desired to alter the size of the fold and the positions of the side walls 106 of the layering chute 22 and the outside walls 105 of the upper and lower chutes 24 and 26 must be adjusted accordingly as well. The size of the fold is manually inputed into the controller 124 and the controller adjusts the feed rate of the feed rolls 18*a* and 18*b* according to the size of the fold.

A cut-off electric eye 134 is disposed on the traveling frame 14 adjacent to the roll of ceramic batting 16. When the roll of ceramic batting 16 is depleted, the cut-off electric eye 134 detects the end of the batting 16 and a signal is sent to the controller 124. This signal, in conjunction with the data in the controller 124 regarding the size of the fold of batting 16 being produced and the position of the traveling frame 40, is used to shut off the apparatus and to cut off the end of the batting so that the apparatus 10 stops operating exactly at the midpoint of a fold. The apparatus 10 has this capability because the controller 124 counts the teeth on the crank wheel 70 as they pass the reciprocating mechanism electric eye 126, and the center position of the traveling frame 14 is signaled by the reciprocation electric eye 126. Consequently, the position of the traveling frame 14, and thus the progression of the folding cycle is monitored at all times and is divided into eight portions for each one-half cycle. When the signal is received from the cut-off electric eye 134, indicating that the batting 16 is depleted, the apparatus 10 will continue to operate until less than enough material remains to make one-half of a fold. At this point, the controller 124 actuates the air cylinder 120 and the planer blade 118 to cut off the remaining material. From the monitoring of the progression of the folding cycle, the controller 124 is capable of actuating the air cylinder 120 and the planar blade 118 to cut the batting 16 at the proper time to produce one-half fold of batting 16. Since the fold of the batting 16 is normally cut in half by the band saw 23, the end of the half fold will be positioned in the chute 22 where it normally would have been cut. At this time, the controller 124 stops operation of the apparatus 10, and a new roll of batting 16 is fed into the apparatus 10 with the front end of the new roll abutting the cut and trailing end of the old roll of batting 16.

The controller 124 also controls the counting and fastening stations 28 and 30. At both the upper and lower counting and fastening stations 28 and 30, upper and lower fold counter electric eyes 136 and 137, respectively, send a signal to the controller 124 as each of the folded units are advanced into the counting and fastening stations 28 and 30 by the upper and lower belts 112. The upper and lower fold counter electric eyes 136 and 137 operate independently and the controller 124 counts folds on each side independently. When seven folds have been counted at the upper counting and fastening station 28, the controller 124 stops the motion of the upper and lower belts 112 and actuates the keeper plate air cylinder 111 which places keeper plate 110 in the path of oncoming folded units. The first pusher 114 and air cylinder 116 located in the upper counting and fastening station 28 is then actuated by the controller 124 to eject the seven folded units collectively out of the upper counting and fastening station 28. After the first pusher 114 withdraws from the counting and fastening station 28, the controller 124 signals keeper plate air cylinder 111 to withdraw the keeper plate 110 and also restarts the motion of the upper and lower belts 112 to advance additional folded units into the counting and fastening station 28. When seven units have again entered the station 28, the keeper plate 110 is again placed in the path of the folded units and the motion of the belts 112 is again stopped.

If the second pusher 116 and the second air cylinder 117 has not been actuated to rotate the seven folded units 90°, the controller 124 will now stop the operation of the apparatus 10. The second pusher air cylinder 117 must be actuated manually by the operator of the apparatus 10 to cause the second pusher 115 to position the seven units for fastening by means of a conventional banding machine or other method. After the second pusher is actuated, the controller 124 will resume operation of the apparatus 10.

The lower counting and fastening station 30 operates in an identical fashion to station 28. Although the upper and lower counting and fastening stations 28 and 30 operate independently, if the second pusher 115 is not actuated at either the upper or lower counting and fastening station 28 or 30, the controller 124 will stop operation of the apparatus 10.

In operation, a roll of ceramic batting 16 is placed on the turntable and vertical spindle 32. The batting must actually be advanced to the start-up feed mechanism 34 manually. Then the start-up feed mechanism air cylinder is actuated by the operator to make the start-up feed belts 36 contact the batting 16 to the feed rolls **18*a* and 18*b*. When the batting is sufficiently fed into the apparatus 10 so that the feed rolls 18*a* and 18*b* are capable of feeding the batting into the layering chute 22, the operator of the apparatus 10 may disengage the start-up feed mechanism 34 and may then let the controller 124 monitor the operation of the apparatus 10. Until the layering chute 22 and both the upper and lower chutes 26 and 28** are filled with folded batting, however, it may be necessary for the operator to manually maintain back pressure on the folded material until all of the chutes are full.

The feed rolls **18*a* and 18*b* are reciprocated on the traveling frame 14 which folds the batting as it is fed into the layering chute 22. The surface defining mechanism 19 acts cooperatively with the feed rolls 18*a* and 18*b* to produce folds. Additionally, the surface defining mechanism 19 drives or advances the folded batting into the layering chute. The folded batting being urged through the chute 22 is then cut vertically by the band saw 23 and the units produced are fed by the upper and lower chutes 24 and 26 to the upper and lower counting and fastening stations 28 and 30. The fold counter electric eyes 136 produce signals as the folded units are fed into the upper and lower counting and fastening stations 28 and 30. When seven units are assembled in a station a first pusher 114 is actuated by the controller 124 to eject seven units from the station. The operator of the apparatus 10 then actuates the second pusher 115 to rotate the units 90° for fastening the units together to form a module 31 (FIG. 3**).

When the roll of ceramic batting 16 is depleted, the planar blade 118 cuts the batting 16 so that one-half fold is completed in the layering chute 22 and the controller 124 then stops the apparatus 10. This operation functions to ultimately yield one last folded unit of the same size as all of the previously produced folded units and waste is minimized. The piece of batting 16 cut from the end of the web must then be removed from the equipment manually. A new roll of ceramic batting 16 may then be loaded into the apparatus 10 and the operation of the apparatus 10 may be resumed.

Although a particular embodiment of the present invention has been described in the foregoing detailed description it will be understood that the invention is capable of numerous modifications without departing from the spirit of the invention.

What is claimed is:

1. An apparatus for folding a web of material into a serpentine configuration comprising:

a chute for receiving the web of material;

feed means for feeding the web in an initial feed path toward the chute at a selected feed rate;

means for reciprocating said feed means at a selected reciprocation rate in a transverse direction generally perpendicular to the initial feed path;

surface defining means disposed between said feed means and said chute;

an aperture defined in said surface defining means for admittng the web therethrough and into said chute;

means for moving said aperture at the selected reciprocation rate in a reciprocal motion to follow the motion of said feed means so that said feed means, said surface defining means and said aperture operate cooperatively to fold the web in the chute and said surface defining means urges the folded web into and through the chute.

2. The apparatus of claim 1 wherein said feed means comprises:

two rotatably mounted vertical drive rolls; and means for rotating said drive rolls so that said drive rolls are rotated in opposite directions to feed the web into said chute.

3. The apparatus of claim 1 wherein said means for reciprocating is adjustable so that the reciprocable travel of said feed means may be varied to produce different sized folds.

4. The apparatus of claim 5 wherein said means for reciprocating said feed means comprises:

a rotatable disk;

a crank arm; and means for attaching said crank arm at different positions on said disk to vary the length of the stroke of said crank arm.

5. The apparatus of claim 1 further comprising means for controlling said feed rate of said feed means and for controlling said reciprocating rate of said reciprocating means so that the required quantity of web is fed into said chute for each folded section of said web.

6. The apparatus of claim 1 wherein said surface defining means comprises first and second abutment surfaces disposed on opposite sides of said aperture and defining said aperture, said first and second abutment surfaces being stationary with respect to the folded web disposed within said chute and having dimensions perpendicular to the initial feed path that vary with the motion of said aperture.

7. An apparatus for folding a web of material into a serpentine configuration comprising:

a chute for receiving the web of material;

feed means for feeding the web in an initial feed path toward the chute at a selected feed rate;

means for reciprocating the feed means at a selected reciprocation rate in a transverse direction generally perpendicular to the initial feed path;

surface defining means disposed between said feed means and said chute;

an aperture defined in said surface defining means for admitting the web therethrough and into said chute;

means for moving said aperture at the selected reciprocation rate in a reciprocal motion to follow the motion of said feed means so that said feed means and said aperture operate cooperatively to fold the web in the chute and to urge the folded web through the chute;

said surface defining means comprising:

first and second parallel spaced-apart shafts mounted adjacent to said feed means and between said feed means and said chute;

first and second sheets of flexible material having a fixed end and a free end;

means for anchoring the fixed end of each of said sheets at opposite stationary positions lateral from said first and second parallel shafts and generally between said feed means and said chute;

each of said sheets having face sections extending from said anchor means toward said first and second shafts and being disposed to engage the folded web in said chute, said face section presenting stationary surfaces to the folded web in said chute;

each of said sheets having midsections, the midsection of said first sheet being disposed around and carried on said first shaft and the midsection of said second sheet being disposed around and carried on said second shaft;

each of said sheets having a tail section extending from the midsection to the free end of said sheet;

means for yieldably holding the free end of each of said sheets to hold said first and second sheets tautly on said first and second shafts;

said aperture being defined by the space between said first and second shafts;

said means for moving said aperture being operable to move said first and second shafts in unison in a reciprocal motion to reciprocate said aperture; and said means for yieldably holding the free end of each of said sheets being operable to allow movement of the free end of one sheet toward said shafts and to allow movement of the free end of the other of said sheets away from said shafts as said shafts are reciprocated and to maintain both sheets in a taut condition, whereby said first and second sheets are operable to drive the folded serpentine web down said chute and to cooperatively effect the folding of said web.

8. The apparatus of claim 7 wherein said means for yieldably holding said free ends of said sheets comprises cables and pulleys connecting said free ends.

9. An apparatus for manufacturing a module from an elongated web of material, comprising:

feed means for feeding the web in an initial feed path toward the chute at a selected feed rate;

means for monitoring said feed rate and producing a feed rate signal corresponding to said feed rate;

means for reciprocating said feed means at a selected reciprocation rate in a transverse direction generally perpendicular to said initial feed path so that said feed means feeds the web into the chute in a serpentine configuration;

means for monitoring said reciprocation rate of said feed means and producing a reciprocation rate signal corresponding to said reciprocation rate; and control means responsive to said feed rate signal and said reciprocation rate signal for controlling said feed rate and the reciprocation rate so that the required quantity of web is fed into said chute for each reciprocation cycle;

means for cutting the folded web longitudinally and generally parallel to the rows of folded edges of the folded web to produce a series of separate folded units; and means for separating a selected number of said separate folded units for being secured together to produce a module.

10. The apparatus of claim 9 wherein said feed means further comprises:

surface defining means disposed between said feed means and the chute;

an aperture defined in said surface defining means for admitting the web therethrough and into said chute; and means for moving said aperture in a reciprocal motion to follow the motion of said feed means so that said feed means and said aperture operate cooperatively to fold the web in the chute and to urge the folded web through the chute.

11. The apparatus of claim 9 wherein said means for monitoring said reciprocation rate and producing a reciprocation rate signal comprises:

a first monitor actuated when the feed means passes a stationary position; and a second monitor for monitoring a fractional portion of the reciprocation cycle.

12. The apparatus of claim 9 further comprising:

means for cutting the web generally perpendicular to its length;

means to detect the end of the web; and means responsive to said first and second counters and said end detection means for actuating said cutter so that said web is cut to form one-half of one fold at the end of the folded web in the chute with the remaining unused portion of the web being insufficient to form another one-half fold.

13. An apparatus for folding a web of material into a serpentine configuration within a chute comprising:

feed means for feeding the web in an initial feed path toward the chute at a selected feed rate;

means for monitoring said feed rate and producing a feed rate signal corresponding to said feed rate;

means for reciprocating said feed means at a selected reciprocation rate in a transverse direction generally perpendicular to said initial feed path so that said feed means feeds the web into the chute in a serpentine configuration;

means for monitoring said reciprocation rate of said feed means and producing a reciprocation rate signal corresponding to said reciprocation rate; and control means responsive to said feed rate signal and said reciprocation rate signal for controlling said feed rate and the reciprocation rate so that the required quantity of web is fed into said chute for each reciprocation cycle.

14. The apparatus of claim 13 wherein said feed means further comprises:

surface defining means disposed between said feed means and the chute;

an aperture defined in said surface defining means for admitting the web therethrough and into said chute; and means for moving said aperture in a reciprocal motion to follow the motion of said feed means so that said feed means and said aperture operate cooperatively to fold the web in the chute and to urge the folded web through the chute.

15. The apparatus of claim 13 wherein said means for monitoring said reciprocation rate and producing a reciprocation rate signal comprises:

a first monitor actuated when the feed means passes a stationary position; and a second monitor for monitoring a fractional portion of the reciprocation cycle.

16. The apparatus of claim 13 further comprising:

means for cutting the web generally perpendicular to its length;

means to detect the end of the web;

means responsive to said first and second counters and said end detection means for actuating said cutter so that said web is cut to form one-half of one fold at the end of the folded web in the chute with the remaining unused portion of the web being insufficient to form another one-half fold.

17. An apparatus for manufacturing a module from an elongated web of material, comprising:

a chute for receiving the web of material;

feed means for feeding the web in an initial feed path toward the chute at a selected feed rate;

means for reciprocating the feed means at a selected reciprocation rate in a transverse direction generally perpendicular to the initial feed path;

surface defining means disposed between said feed means and said chute;

an aperture defined in said surface defining means for admitting the web therethrough and into said chute;

means for moving said aperture at the selected reciprocation rate in a reciprocal motion to follow the motion of said feed means so that said feed means, said surface defining means and said aperture operate cooperatively to fold the web in the chute and surface defining means urges the folded web into and through the chute;

means for cutting the folded web longitudinally and generally parallel to the rows of folded edges of the folded web to produce a series of separate folded units; and means for separating a selected number of said separate folded units for being secured together to produce a module.

18. The apparatus of claim 17 wherein said surface defining means comprises first and second abutment surfaces disposed on opposite sides of said aperture and defining said aperture, said first and second abutment surfaces being stationary with respect to the folded web disposed within said chute and having dimensions perpendicular to the initial feed path that vary with the motion of said aperture.

19. The apparatus of claim 17 wherein said feed means comprises:

two rotatably mounted vertical drive rolls; and means for rotating said drive rolls so that said drive rolls are rotated in opposite directions to feed the web into said chute.

20. The apparatus of claim 17 wherein said means for reciprocating is adjustable so that the reciprocable travel of said feed means may be varied to produce different sized folds.

21. The apparatus of claim 17 wherein said means for reciprocating said feed means comprises:

a rotatable disk;

a crank arm; and means for attaching said crank arm at different positions on said disk to vary the length of the stroke of said crank arm.

22. The apparatus of claim 17 further comprising means for controlling said feed rate of said feed means and for controlling said reciprocating rate of said reciprocating means so that the required quantity of web is fed into said chute for each folded section of said web.

23. An apparatus for manufacturing a module from an elongated web of material, comprising:

a chute for receiving the web of material;

feed means for feeding the web in an initial feed path toward the chute at a selected feed rate;

means for reciprocating the feed means at a select reciprocation rate in a transverse direction generally perpendicular to the initial feed path;

surface defining means disposed between said feed means and said chute;

an aperture defined in said surface defining means for admitting the web therethrough and into said chute; and means for moving said aperture at the selected reciprocation rate in a reciprocal motion to follow the motion of said feed means so that said feed means and said aperture operate cooperatively to fold the web in the chute and to urge the folded web through the chute;

means for cutting the folded web longitudinally and generally parallel to the rows of folded edges of the folded web to produce a series of separate folded units; and means for separating a selected number of said separate folded units for being secured together to produce a module;

said surface defining means comprising:

first and second parallel spaced-apart shafts mounted adjacent to said feed means and between said feed means and said chute;

first and second sheets of flexible material each having a fixed end and a free end;

means for anchoring the fixed end of each of said sheets at opposite stationary positions lateral from said first and second parallel shafts and generally between said feed means and said chute;

each of said sheets having face sections extending from said anchor means toward said first and second shafts and being disposed to engage the folded web in said chute, said face section presenting stationary surfaces to the folded web in said chute;

each of said sheets having midsection, the midsection of said first sheet being disposed around and carried on said first shaft and the midsection of said second sheet being disposed around and carried on said second shaft;

each of said sheets having a tail section extending from the midsection to the free end of said sheet;

means for yieldably holding the free end of each of said sheets to hold said first and second sheets tautly on said first and second shafts;

said aperture being defined by the space between said first and second shafts;

said means for moving said aperture being operable to move said first and second shafts in unison in a reciprocal motion to reciprocate said aperture; and said means for yieldably holding the free end of each of said sheets being operable to allow movement of the free end of one sheet toward said shafts and to allow movement of the free end of the other of said sheets away from said shafts as said shafts are reciprocated and to maintain both sheets in a taut condition, whereby said first and second sheets are operable to drive the folded serpentine web down said chute and to cooperatively effect the folding of said web.

24. The apparatus of claim 23 wherein said means for yieldably holding said free ends of said sheets comprises cables and pulleys connecting said free ends.

* * * * *